US009895882B2

(12) United States Patent
Netsu et al.

(10) Patent No.: US 9,895,882 B2
(45) Date of Patent: Feb. 20, 2018

(54) DRIVING DEVICE FOR A LIQUID EJECTION HEAD

(71) Applicant: CANON KABUSHIKI KAISHA, Tokyo (JP)

(72) Inventors: Hiroshi Netsu, Yokohama (JP); Yasuyuki Tamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/292,536

(22) Filed: Oct. 13, 2016

(65) Prior Publication Data

US 2017/0113461 A1 Apr. 27, 2017

(30) Foreign Application Priority Data

Oct. 22, 2015 (JP) ..... 2015-208143

(51) Int. Cl.
*B41J 2/045* (2006.01)

(52) U.S. Cl.
CPC ..... *B41J 2/04588* (2013.01); *B41J 2/0459* (2013.01); *B41J 2/04541* (2013.01); *B41J 2/04581* (2013.01); *B41J 2/04593* (2013.01)

(58) Field of Classification Search
CPC ..... B41J 2/04588; B41J 2/04541; B41J 2/04581; B41J 2/21; B41J 2/0459; B41J 2/04593
See application file for complete search history.

(56) References Cited

U.S. PATENT DOCUMENTS

2003/0142153 A1* 7/2003 Nakajima ..... B41J 2/04521 347/9
2006/0044337 A1* 3/2006 Takata ..... B41J 2/0457 347/14
2009/0141059 A1* 6/2009 Moriyama ..... B41J 2/04541 347/11

FOREIGN PATENT DOCUMENTS

JP 2010-042511 A 2/2010

* cited by examiner

*Primary Examiner* — Thinh H Nguyen
(74) *Attorney, Agent, or Firm* — Fitzpatrick, Cella, Harper & Scinto

(57) ABSTRACT

A driving device for a liquid ejection head is configured to drive a plurality of piezoelectric elements of a liquid ejection head, the liquid ejection head including a plurality of ejection orifices configured to eject liquid and the plurality of piezoelectric elements configured to generate energy for ejecting liquid from the plurality of ejection orifices. The driving device includes a control circuit unit including storage sections and transfer circuits, and a drive circuit unit including a plurality of individual drive circuit sections. The control circuit unit is an integrated circuit which is different from the drive circuit unit.

6 Claims, 5 Drawing Sheets

DRIVING DEVICE FOR A LIQUID EJECTION HEAD

BACKGROUND OF THE INVENTION

Field of the Invention

The present invention relates to a driving device for a liquid ejection head.

Description of the Related Art

There has been known a liquid ejection printing apparatus configured to eject liquid such as ink to perform printing. The liquid ejection printing apparatus includes a liquid ejection head configured to eject liquid. The liquid ejection head may include ejection orifices configured to eject liquid, pressure chambers communicating with the respective ejection orifices, liquid supply paths configured to supply the liquid to the respective pressure chambers, and energy-generating elements arranged for the respective ejection orifices. The energy-generating element may be made of a piezoelectric material such as lead zirconate titanate (PZT) and configured to change a volume of the pressure chamber to supply and eject liquid. When the volume of the pressure chamber is contracted, the liquid in the pressure chamber is ejected from the ejection orifice as droplets. When the volume of the pressure chamber is expanded, the liquid is supplied from the liquid supply path to the pressure chamber.

In the field of the printing apparatus, in recent years, there has been a demand for higher image quality and higher speed. Thus, the liquid ejection head has been required to have a large number of ejection orifices arranged in high density. In order to reduce unevenness in printing to achieve high image quality, smaller variation in ejection properties of the ejection orifices is required. However, there is more difficulty in manufacturing all the ejection orifices without variation in the ejection properties as the number of ejection orifices increases. Thus, there arise problems such as a rise in manufacturing cost and degradation of a yield.

In order to deal with such problems, in Japanese Patent Application Laid-Open No. 2010-42511, there is disclosed a technology of driving a liquid ejection head with use of different drive waveforms for respective ejection orifices, to thereby attain uniform ejection properties of the ejection orifices even when the ejection orifices have different ejection properties. According to this technology, a driver integrated circuit (IC) configured to drive the liquid ejection head includes a storage section configured to store a plurality of waveform patterns and a selector configured to select one waveform pattern from the plurality of waveform patterns for each ejection orifice. The driver IC further includes a digital/analog (D/A) conversion circuit and a buffer amplifier. With this configuration, an ejection amount is corrected for each ejection orifice, to thereby reduce the difference in ejection properties.

However, in the technology disclosed in Japanese Patent Application Laid-Open No. 2010-42511, a large number of memories and logic circuits are required, and hence there is a problem in that a substrate area of the driver IC increases to cause an increase in the cost for manufacturing the liquid ejection head. In particular, in a case where an energy-generating element requiring a high-voltage drive waveform such as a piezoelectric element made of PZT is used, high-voltage processing is used. A driver IC for high voltage is higher in manufacturing cost as compared to an IC which is manufactured through typical complementary metal oxide semiconductor (CMOS) processing for a logic circuit. Further, refinement of the driver IC for high voltage is difficult.

Thus, an area of the driver IC becomes larger relative to a circuit scale, with the result that the manufacturing cost is increased. Further, as the number of ejection orifices increases, the number of driver ICs to be used also increases, with the result that the manufacturing cost for the liquid ejection head increases accordingly.

SUMMARY OF THE INVENTION

It is an object of the present invention to provide a liquid ejection head capable of suppressing an increase in manufacturing cost even in a case where a high-voltage drive waveform is required at a time of correcting an ejection amount for each ejection orifice.

According to one embodiment of the present invention, there is provided a driving device for a liquid ejection head, which is configured to drive a plurality of piezoelectric elements of a liquid ejection head, the liquid ejection head including a plurality of ejection orifices configured to eject liquid and the plurality of piezoelectric elements configured to generate energy for ejecting liquid from the plurality of ejection orifices. The driving device for a liquid ejection head includes: a control circuit unit including: storage sections configured to store a plurality of pieces of drive voltage waveform data of different waveforms for controlling an ejection amount of the liquid; and a transfer circuit configured to transfer the plurality of pieces of drive voltage waveform data stored in the storage sections; and a drive circuit unit including a plurality of individual drive circuit sections which are arranged so as to correspond to the plurality of piezoelectric elements, respectively, and each configured to select one of the plurality of pieces of drive voltage waveform data transferred by the transfer circuit to generate a drive voltage for driving a corresponding piezoelectric element with use of a selected piece of drive voltage waveform data. The control circuit unit is an integrated circuit which is different from the drive circuit unit.

Further features of the present invention will become apparent from the following description of exemplary embodiments with reference to the attached drawings.

DESCRIPTION OF THE EMBODIMENTS

Now, embodiments of the present invention are described with reference to the attached drawings. The components having like functions throughout the specification and the drawings are denoted by like reference symbols to omit redundant description.

First Embodiment

<Configuration Example of Driving Device 100>

Figure 1:
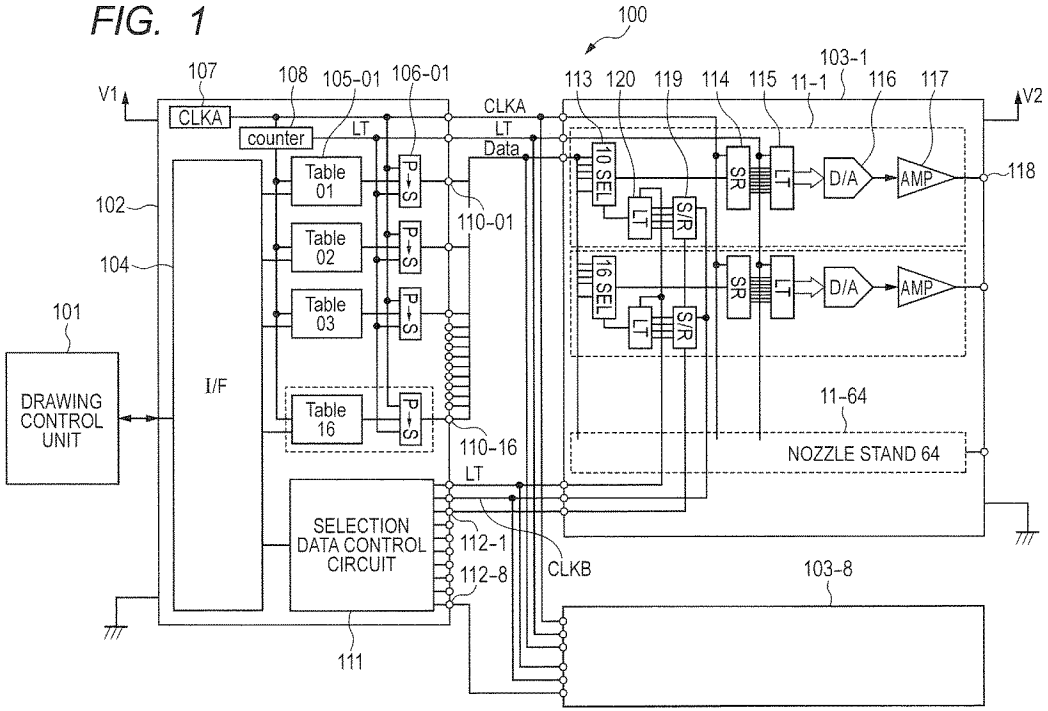
FIG. 1 is a diagram for illustrating a drive circuit according to a first embodiment of the present invention.

FIG. 1 is an illustration of a configuration of a driving device 100 for a liquid ejection head according to a first embodiment of the present invention. In this embodiment, variation in ejection amount of liquid ejected from each ejection orifice is corrected by properly using sixteen kinds of drive waveforms.

In the following description and the drawings, a plurality of components having substantially the same functional configuration may be identified by different numbers given after the same reference symbol via a hyphen. In such a case, when there is no need to particularly identify each of the plurality of components having substantially the same functional configuration, only the same reference symbol is given.

The liquid ejection head to be driven by the driving device 100 includes a plurality of ejection orifices and energy-generating elements. The energy-generating elements are arranged so as to correspond to the plurality of ejection orifices, respectively, and configured to generate energy for ejection of liquid from the corresponding ejection orifices. The energy-generating elements are piezoelectric elements such as PZT actuators. The driving device 100 is configured to drive the piezoelectric elements. The driving device 100 includes a drawing control unit 101, a control circuit unit 102, and a drive circuit unit 103. The drawing control unit 101 is configured to generate and send out drawing data which corresponds to an image to be drawn with use of the liquid ejection head driven by the driving device 100. The control circuit unit 102 is configured to control driving of the piezoelectric elements based on the drawing data sent out from the drawing control unit 101. The drive circuit unit 103 is configured to generate drive waveforms for driving the piezoelectric elements based on control signals from the control circuit unit 102, and to output the voltage waveforms for driving the piezoelectric elements. The control circuit unit 102 and the drive circuit unit 103 are different integrated circuits which are manufactured through different processing. For the piezoelectric element made of PZT or the like, a drive waveform of a high voltage such as 30 V is required to be generated, and a circuit configured to drive such a piezoelectric element is manufactured through high-voltage processing. In this regard, in this embodiment, the control circuit unit 102 and the drive circuit unit 103 are provided as different integrated circuits. A portion which needs to be manufactured through high-voltage processing is provided in the drive circuit unit 103, and a portion which needs not to be manufactured through high-voltage processing is provided in the control circuit unit 102. In this case, a drive voltage V1 for the control circuit unit 102 is lower than a drive voltage V2 for the drive circuit unit 103. With this configuration, the circuit scale of the portion manufactured through high-voltage processing is decreased, thereby being capable of reducing the cost.

More detailed configuration of the control circuit unit 102 is described. The control circuit unit 102 includes an interface section 104, data tables 105, parallel/serial (P/S) converters 106, a clock-generating circuit 107, and a counter 108. The control circuit unit 102 further includes drive voltage waveform data output portions 110, a selection data control circuit 111, and selection data output terminals 112. The interface section 104 is an interface with respect to the drawing control unit 101 and is configured to receive drawing data from the drawing control unit 101. The data tables 105 are storage sections configured to store a plurality of kinds of drive voltage waveform data for driving the piezoelectric elements. The P/S converters 106 are transfer circuits configured to convert the pieces of drive voltage waveform data stored in the data tables 105 from parallel data into serial data, and to output the serial data to transfer the pieces of drive voltage waveform data. The clock-generating circuit 107 and the counter 108 are configured to read the data tables 105 to generate timings for transferring data from the P/S converters 106. The drive voltage waveform data output portions 110 are interfaces configured to output the drive voltage waveform data. Herein, the control circuit unit 102 includes sixteen data tables 105-01 to 105-16 and includes P/S converters 106-01 to 106-16 and drive voltage waveform data output portions 110-01 to 110-16 which are arranged so as to correspond to the data tables 105-01 to 105-16, respectively. The selection data control circuit 111 and the selection data output terminals 112 are configured to convert data to be drawn into waveform selection data of drive waveforms, and to send out the waveform selection data serially.

More detailed configuration of the drive circuit unit 103 is described. The driving device 100 includes a plurality of drive circuit units 103. In this example, the driving device 100 includes eight drive circuit units 103-1 to 103-8. Each of the drive circuit units 103 includes a plurality of individual drive circuit sections 11 arranged so as to correspond to the piezoelectric elements, respectively. In this example, each of the drive circuit units 103-1 to 103-8 includes sixty-four individual drive circuit sections 11-1 to 11-64.

Each individual drive circuit section 11 includes a selector 113, a shift register 114, a latch circuit 115, a digital/analog (D/A) conversion circuit 116, an amplifier 117, and a drive waveform output terminal 118. Each individual drive circuit section 11 further includes a shift register 119 and a latch circuit 120.

The selector 113 is configured to select one of pieces of drive voltage waveform data serially transferred from the control circuit unit 102. The selector 113 receives output from the drive voltage waveform data output portions 110-01 to 110-16 and output from the latch circuit 120. Thus, in a case where the driving device 100 includes the plurality of drive circuit units 103-1 to 103-8, the control circuit unit 102 transfers the same drive voltage waveform data to the plurality of drive circuit units 103-1 to 103-8. The shift register 114 is configured to convert a serial signal selected by the selector 113 into parallel. The latch circuit 115 is configured to latch output of the shift register 114. The D/A conversion circuit 116 is configured to convert data of the latch circuit 115 into an analog voltage. The amplifier 117 is configured to amplify output of the D/A conversion circuit 116 to generate a drive voltage for driving the piezoelectric element. The drive waveform output terminal 118 is configured to connect output of the amplifier 117 to an electrode configured to drive the piezoelectric element arranged for each ejection orifice of the liquid ejection head.

The shift register 119 is configured to convert the waveform selection data transmitted from the selection data output terminal 112 of the control circuit unit 102 into parallel. The latch circuit 120 is configured to latch output of the shift register 119.

<Operation Example>

An operation of the driving device 100 illustrated in FIG. 1 to correct an ejection amount of liquid ejected from each ejection orifice to draw an image is described. Before drawing is started, the drawing control unit 101 writes drive waveforms having different ejection properties to the data tables 105-01 to 105-16 of the control circuit unit 102, respectively, through the interface section 104.

Figure 2:
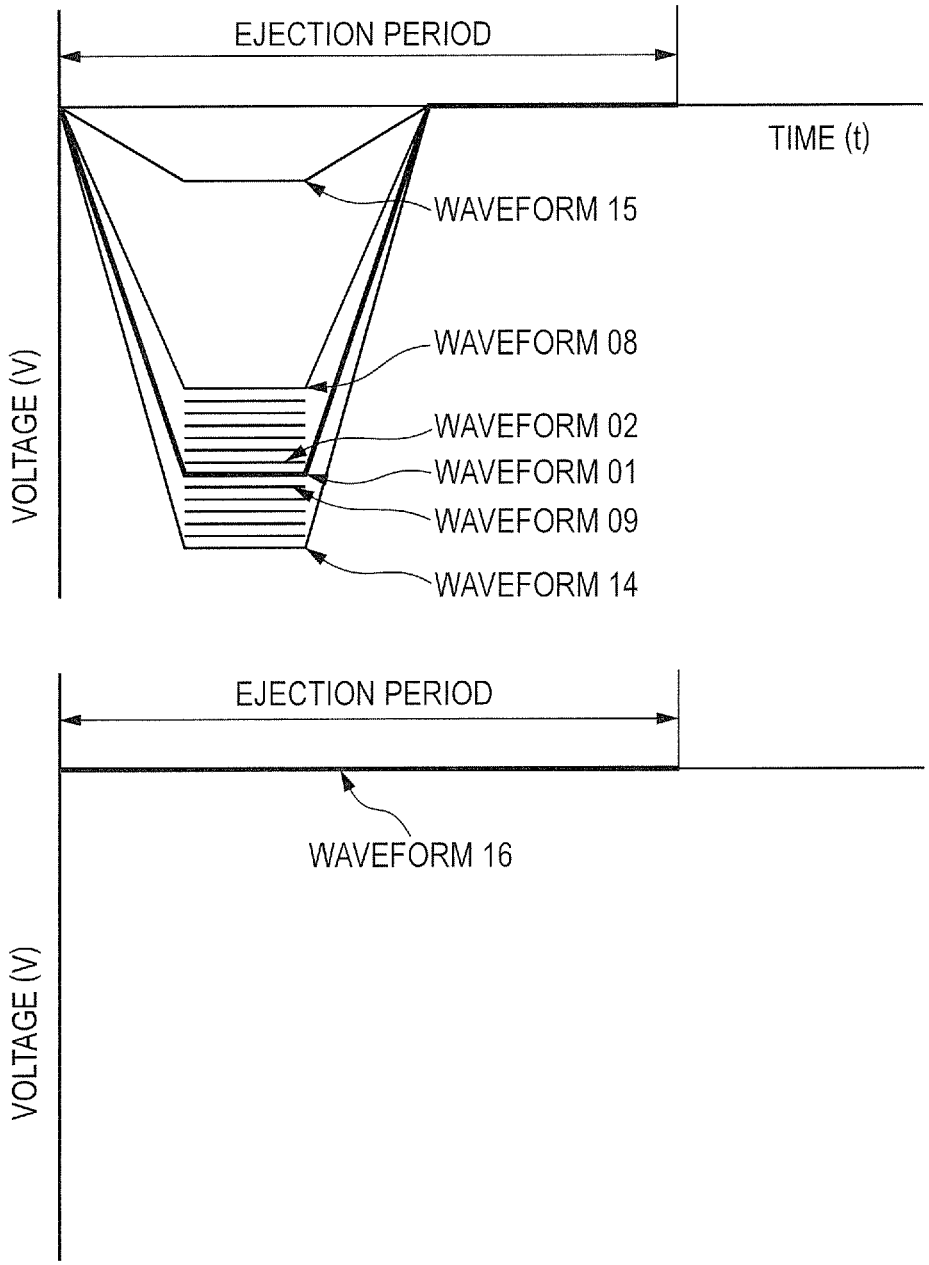
FIG. 2 is a diagram for illustrating drive waveforms for correction of an ejection amount.

FIG. 2 is a diagram for illustrating examples of the drive waveforms to be used for correction of the ejection amount, and a plurality of waveforms 01 to 16 having different amplitudes are illustrated. The waveform 01 is a drive waveform enabling ejection of liquid having a reference ejection amount in a case where the waveform 01 is applied to an ejection orifice having a standard ejection property. The waveforms 01 to 16 are properly used depending on the ejection amount given in a case where the waveform 01 is applied, to thereby correct the ejection amount to be close to the reference ejection amount. For example, the waveform 02 has an amplitude smaller than the amplitude of the waveform 01. The waveform 02 is applied to a piezoelectric element corresponding to an ejection orifice having an ejection amount slightly larger than the reference ejection amount given in the case where the waveform 01 is applied, to thereby slightly reduce the ejection amount of liquid ejected from this ejection orifice to correct the ejection amount to the reference ejection amount. The waveforms 03 to 08 have amplitudes further smaller than the amplitude of the waveform 02. The waveforms 02 to 08 are properly used depending on the ejection amount given in the case where the waveform 01 is applied, to thereby reduce the ejection amount of liquid ejected from an ejection orifice having an ejection amount larger than the reference ejection amount to correct the ejection amount to be close to the reference ejection amount. The waveform 09 has an amplitude slightly larger than the amplitude of the waveform 01. The waveform 09 is applied to a piezoelectric element corresponding to an ejection orifice having the ejection amount slightly smaller than the reference ejection amount given in the case where the waveform 01 is applied, to thereby increase the ejection amount of liquid ejected from this ejection orifice to correct the ejection amount to be close to the reference ejection amount. The waveforms 10 to 14 have amplitudes further larger than the amplitude of the waveform 09. The waveforms 09 to 14 are properly used depending on the ejection amount given in the case where the waveform 01 is applied, to thereby increase the ejection amount of liquid ejected from an ejection orifice having an ejection amount smaller than the reference ejection amount to correct the ejection amount to be close to the reference ejection amount. The waveform 15 is a drive waveform having an amplitude to an extent that application of the drive waveform to the piezoelectric element may cause vibration in meniscus of the ejection orifice but no ejection of liquid. When ejection is not performed for a long period of time, a moisture content of liquid is evaporated from the ejection orifice, and liquid is increased in viscosity, with the result that the ejection property is changed. Thus, the waveform 15 is applied to a piezoelectric element corresponding to an ejection orifice not having performed ejection for a certain period of time or more to stir liquid in the vicinity of the ejection orifice, thereby being capable of preventing the change in the ejection property due to the increase in viscosity. The waveform 16 is a drive waveform to be applied to a piezoelectric element corresponding to an ejection orifice not performing ejection. The pieces of drive voltage waveform data stored in the data tables 105-01 to 105-16 are pieces of digital data obtained by digitalizing amplitudes of the waveforms 01 to 16 into 8-bit data exhibiting the change in the waveform per 100 ns.

The selection data control circuit 111 includes a correction table for designation of a waveform to be used for each ejection orifice (that is, for each piezoelectric element) in order to correct the ejection property of each ejection orifice. This correction table is recorded and stored in accordance with data from the drawing control unit 101 before drawing is started.

Figure 3:
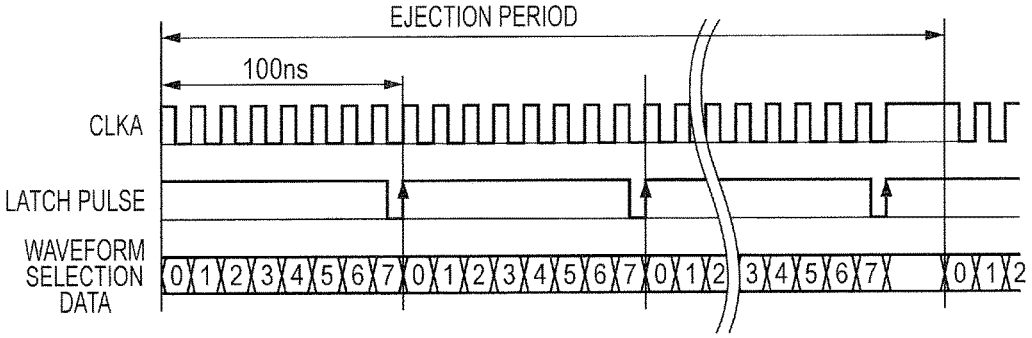
FIG. 3 is an explanatory diagram for illustrating transfer timings of drive voltage waveform data.

FIG. 3 is an explanatory diagram for illustrating transfer timings of the drive voltage waveform data. When printing is started, each piece of data of the data tables 105-01 to 105-16 is transferred in 100 ns from the control circuit unit 102 to the drive circuit unit 103. In the next 100 ns, a reading address of the data tables 105 is incremented by one, and similar transfer is repeated during an ejection period.

A frequency of the clock-generating circuit 107 of the control circuit unit 102 is 80 MHz. The counter 108 generates a frequency of 10 MHz, which is obtained by dividing the frequency of the clock-generating circuit 107 into eight, and a reading address of the data table 105. In accordance with the generated signal, the content of the data table 105 is input to the P/S converter 106 in each 100 ns and then latched. The data latched by the P/S converter 106 is converted into serial data with use of the clock-generating circuit 107, to thereby be output from the drive voltage waveform data output portion 110.

An image to be drawn is converted by the drawing control unit 101 into drawing data indicating which ejection orifice is to be used for ejection, and the drawing data is transferred to the selection data control circuit 111. For each ejection orifice corresponding to the drawing data, the waveform selection data is converted into serial data based on the content of the correction table in the selection data control circuit 111, to thereby be output from the selection data output terminal 112 to the drive circuit unit 103. The waveform selection data is waveform selection data for selection of any one of the waveforms 01 to 14 having different amplitudes with respect to the ejection orifice performing ejection, and is waveform selection data for selection of any one of the waveforms 15 and 16 with respect to the nozzle not performing ejection.

Figure 4:
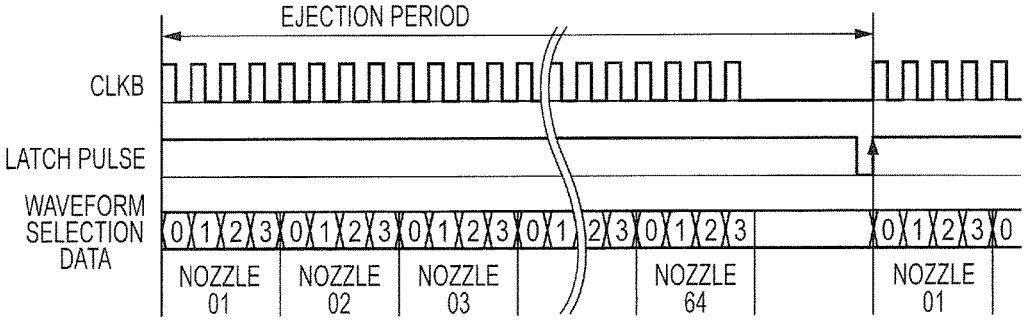
FIG. 4 is an explanatory diagram for illustrating transfer timings of waveform selection data.

FIG. 4 is an explanatory diagram for illustrating transfer timings of the waveform selection data transferred as a serial signal. During each ejection period, 4-bit data for selection of a waveform from sixteen kinds of waveforms per ejection orifice is transferred for each of sixty-four ejection orifices.

The waveform selection data is converted into parallel data by the shift resister 119 of the drive circuit unit 103 and held by the latch circuit 120. The waveform selection data is updated for each ejection period. In accordance with the waveform selection data held by the latch circuit 120, the selector 113 selects one drive waveform from the waveforms transferred from the drive voltage waveform data output portions 110-01 to 110-16 in a serial signal and transfers the drive waveform to the shift register 114. The shift register 114 samples the serial signal in synchronization with the clock-generating circuit 107 and converts the serial signal back into parallel data. This parallel data is held by the latch circuit 115 and input to the D/A conversion circuit 116. The parallel data input to the D/A conversion circuit 116 is converted into an analog voltage signal. The drive voltage waveform data to be input to the D/A conversion circuit 116 is updated for each 100 ns. The analog voltage signal output from the D/A conversion circuit 116 forms a drive waveform and is amplified by the amplifier 117 to a voltage for driving the piezoelectric element, to thereby be output to the drive waveform output terminal 118 as a waveform of a drive voltage. The drive waveform output terminal 118 is connected to an electrode of the piezoelectric element arranged for each ejection orifice of the liquid ejection head. When the drive voltage waveform is applied to the electrode of the piezoelectric element, the piezoelectric element is driven in accordance with the drive voltage waveform, and liquid is ejected from the ejection orifice.

As described above, according to the first embodiment of the present invention, the driving device 100 is configured to drive the plurality of piezoelectric elements of the liquid ejection head including the plurality of ejection orifices and the plurality of piezoelectric elements. This driving device 100 includes the control circuit unit 102 and the drive circuit unit 103. The control circuit unit 102 includes the data tables 105, which are configured to store a plurality of pieces of drive voltage waveform data of different waveforms for controlling the ejection amount of liquid, and the P/S converters 106, which are transfer circuits configured to transfer the plurality of pieces of drive voltage waveform data stored in the data tables 105. The drive circuit unit 103 includes the plurality of individual drive circuit sections 11 arranged so as to correspond to the piezoelectric elements, respectively, and each configured to select one of the plurality of pieces of drive voltage waveform data transferred by the P/S converters 106, which are the transfer circuits, to drive a corresponding piezoelectric element with use of the selected piece of drive voltage waveform data. The control circuit unit 102 is an integrated circuit which is different from the drive circuit unit 103.

According to the driving device 100 described above, the piezoelectric elements are driven with use of the drive voltage waveform data selected for each ejection orifice, thereby being capable of correcting the ejection amount for each ejection orifice. In the driving device 100, the control circuit unit 102 configured to store the drive voltage waveform data and the drive circuit unit 103 configured to generate, from the drive voltage waveform data, the drive voltages to be applied to the respective piezoelectric elements are different integrated circuits. Thus, even when a high-voltage drive waveform is required, there is no need to manufacture the control circuit unit 102 through high-voltage processing, and only the drive circuit unit 103 needs to be manufactured through high-voltage processing. Therefore, as compared to a case where the control circuit unit 102 and the drive circuit unit 103 are mounted to the same integrated circuit and manufactured through the same processing, the circuit scale of the portion which needs to be manufactured through the high-voltage processing can be decreased, thereby being capable of suppressing an increase in cost.

The driving device 100 further includes the plurality of drive circuit units 103, and one control circuit unit 102 transfers the same drive voltage waveform data to each of the plurality of drive circuit units 103. With this configuration, even in a case where the number of ejection orifices is increased, it is only necessary that the number of drive circuit units 103 be increased depending on the number of ejection orifices, and there is no need to increase the number of output terminals for the drive voltage waveform data. Thus, an increase in a circuit area can be suppressed, thereby being capable of suppressing an increase in cost.

In the driving device 100, each individual drive circuit section 11 includes the selector 113, the D/A conversion circuit 116, and the amplifier 117. The selector 113 is a selection circuit configured to select one of the plurality of pieces of drive voltage waveform data transferred by the P/S converter 106 which is a transfer circuit. The D/A conversion circuit 116 is a conversion circuit configured to convert the drive voltage waveform data selected by the selector 113 into analog data. The amplifier 117 is an amplifier circuit configured to amplify a signal obtained by converting the drive voltage waveform data by the D/A conversion circuit 116 to drive the piezoelectric element.

The above-mentioned P/S converter 106 is configured to convert the drive voltage waveform data stored in the data table 105 into serial data, and to transfer the serial data. With this configuration, the drive voltage waveform data is transmitted as serial data from the data table 105 to the selector 113. Thus, as compared to a case where the drive voltage waveform data is transmitted as the parallel data, the number of lines connecting the integrated circuits between the control circuit unit 102 and the drive circuit units 103 can be reduced.

The invention of the subject application is described above with reference to the first embodiment. However, the invention of the subject application is not limited to the embodiment described above. The configuration and details of the invention of the subject application can be modified in various manners within the technical idea of the invention of the subject application.

For example, a plurality of waveforms having different voltage amplitudes are described as examples of the drive waveforms in the embodiment described above. However, the present invention is not limited to those examples. For example, a slope of the waveform may be changed, or a holding time period from expansion to contraction of the pressure chamber may be changed to correct the ejection amount with various waveforms.

Figure 5:
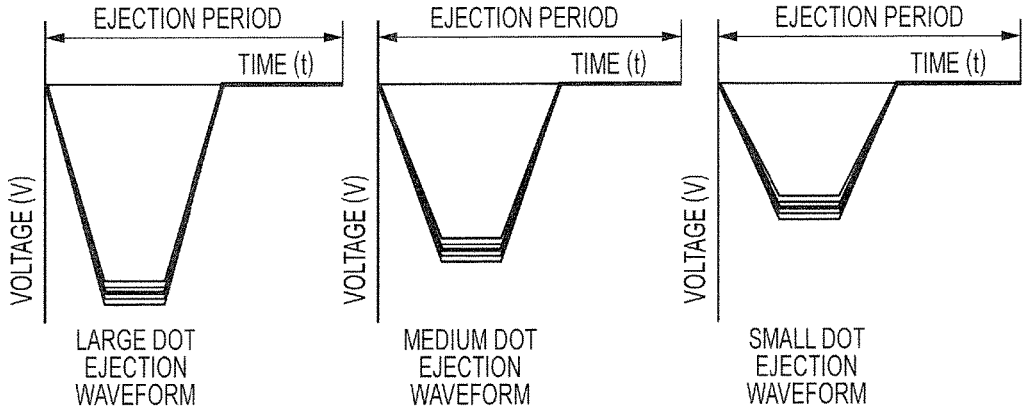
FIG. 5 is a diagram for illustrating examples of the drive waveforms for ejection amount change and ejection amount correction.

In the embodiment described above, the drive waveforms for correcting the ejection amount to be close to one reference ejection amount are described as examples of the drive waveforms. However, as illustrated in FIG. 5, a plurality of reference ejection amounts may be used. For example, with use of a waveform for increasing the ejection amount and a waveform for reducing the ejection amount with respect to each of the plurality of reference ejection amounts, the reference ejection amount can be changed, and correction with respect to each reference ejection amount can be performed. In FIG. 5, there are illustrated three kinds of reference ejection amounts for large dots, middle dots, and small dots, and drive waveforms for correction of the ejection amount with respect to the reference ejection amounts. Specifically, there are illustrated two kinds of drive waveforms for reducing the ejection amount and two kinds of drive waveforms for increasing the ejection amount with respect to each reference ejection amount. There is also illustrated a drive waveform for not performing ejection. In the above-mentioned embodiment, each drive circuit unit 103 can drive the sixty-four piezoelectric elements. The driving device 100 includes eight drive circuit units 103, and hence five hundred and twelve piezoelectric elements can be driven. In order to increase the number of piezoelectric elements to be driven and increase the number of ejection orifices, the number of drive circuit units 103 may be increased. In this case, the drive voltage waveform data, a clock signal, and a latch signal can be input in common with respect to the plurality of drive circuit units 103, and only the selection data output terminals 112 are individually connected to the drive circuit units 103.

Second Embodiment

<Configuration Example of Driving Device 200>

Figure 6:
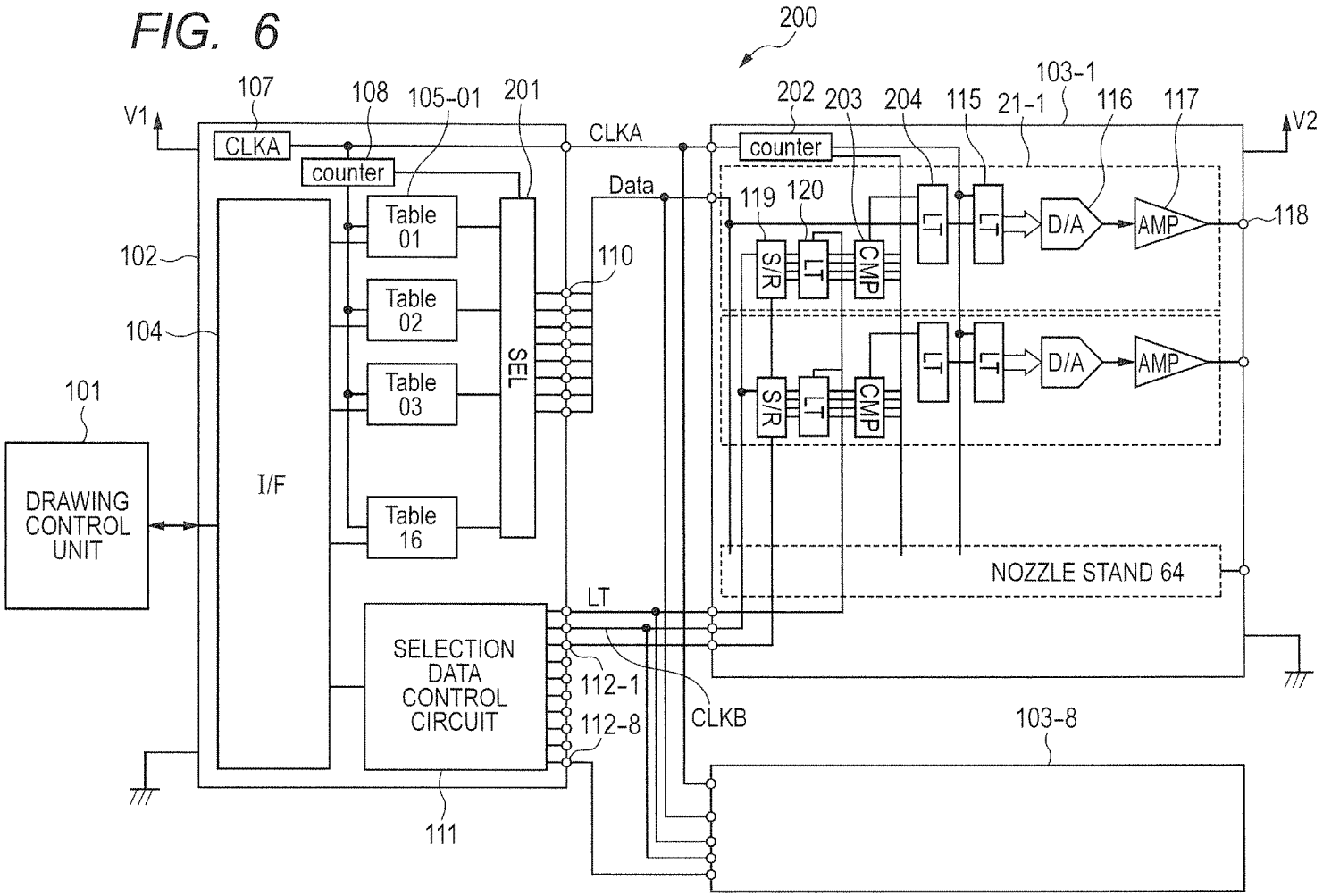
FIG. 6 is a diagram for illustrating a drive circuit according to a second embodiment of the present invention.

FIG. 6 is a diagram for illustrating a configuration of a driving device 200 according to a second embodiment of the present invention. In the first embodiment described above, there is described the configuration in which the drive voltage waveform data is converted into serial data for each waveform and transferred to the drive circuit unit 103. However, in the second embodiment, the drive voltage waveform data is transferred in the form of parallel data. In the following, description on the components which are in common with those of the first embodiment and similar operations is omitted.

In the driving device 200, the frequency of the clock-generating circuit 107 is 160 MHz, and the counter 108 is configured to generate an address of sequentially reading the contents of the data tables 105 and a 4-bit address for the selector. The control circuit unit 102 includes a selector 201 in place of the plurality of P/S converters 106 of the driving device 100. The selector 201 is an 8-bit data selector with sixteen inputs. The selector 201 is configured to sequentially switch pieces of 8-bit data of the sixteen data tables 105-01 to 105-16 with the address of the counter 108 synchronized with the clock-generating circuit 107, and to output the pieces of data to the drive voltage waveform data output portion 110.

Figure 7:
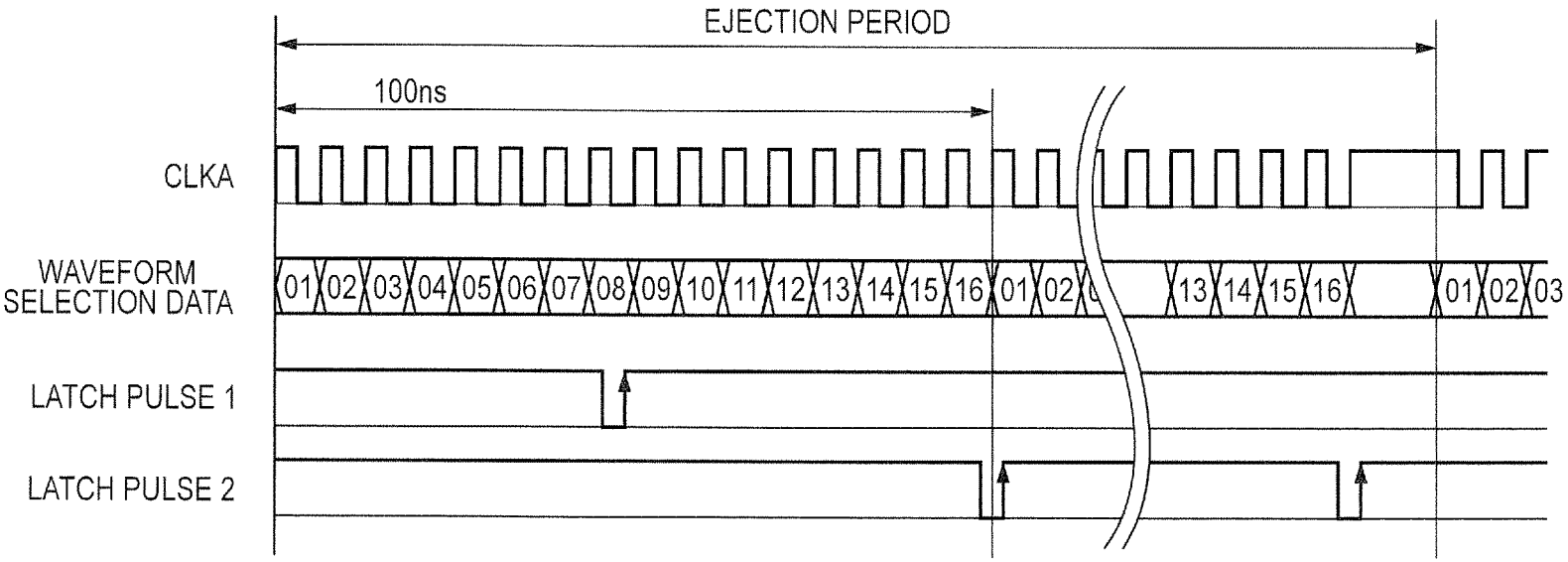
FIG. 7 is an explanatory diagram for illustrating transfer timings of drive voltage waveform data according to the second embodiment.

FIG. 7 is a diagram for illustrating transfer timings of pieces of drive voltage waveform data in the driving device 200. The pieces of data of the data tables 105-01 to 105-16 are transferred in 100 ns. In the next 100 ns, the reading address for the data tables 105 is incremented by one, and similar transfer is repeated during the ejection period.

The drive circuit unit 103 of the driving device 200 includes a counter 202. Further, in the driving device 200, each individual drive circuit 21 of the drive circuit unit 103 includes a comparator 203 and a latch circuit 204 in place of the selector 113 and the shift register 114 of the driving device 100. In the driving device 200, the drive voltage waveform data is output as parallel data to the drive voltage waveform data output portion 110 in time division. The counter 202 is configured to count the order of the sixteen kinds of drive waveforms to be output to the drive voltage waveform data output portion 110. The comparator 203 is configured to generate a latch pulse at a timing of latching necessary waveform data. The latch circuit 204 is configured to store the drive voltage waveform data in synchronization with the latch pulse from the comparator 203. The latch circuit 115 holds again the drive voltage waveform data held by the latch circuit 204 in conformity with the ejection period.

<Operation Example>

As in the case of the first embodiment, an image to be drawn is converted by the drawing control unit 101 into drawing data indicating which nozzle is to be used for ejection, and the drawing data is transferred to the selection data control circuit 111. For each ejection orifice corresponding to the drawing data, the waveform selection data is converted into serial data based on the contents of the correction table in the selection data control circuit 111, to thereby be output from the selection data output terminal 112 to the drive circuit unit 103. The waveform selection data is data for selection of any one of the waveforms 01 to 16. The waveform selection data is converted into parallel data by the shift register 119 of the drive circuit unit 103 and held by the latch circuit 120. The waveform selection data is updated for each ejection period.

A value of the waveform selection data held by the latch circuit 120 and a value of the counter 202 are compared by the comparator 203. When those values are matched, the comparator 203 outputs a pulse for latching the waveform selection data to the latch circuit 204. The contents of the latch circuit 204 may be changed during the update time of 100 ns for the drive waveform. Thus, the drive waveform is latched again by the latch circuit 115 in conformity with a timing of update, input to the D/A conversion circuit 116, and converted into an analog voltage signal.

In the example of FIG. 7, the data table 07-8 is selected at the waveform selection data with the waveform 08. In this case, a latch pulse 1 is output from the comparator 203 at the timing at which the content of the data table 07-8 is output to the drive voltage waveform data output portion 110, and the waveform selection data is held by the latch circuit 120 at this timing. In order to cause the timing of change in the waveform to be in conformity regardless of the selected drive voltage waveform data, the held data is held by the latch circuit 204 with a latch pulse 2 at the update timing of the drive waveform and input to the D/A conversion circuit 116. An analog voltage signal output from the D/A conversion circuit 116 forms the drive waveform, and is amplified by the amplifier 117 to a voltage for driving the piezoelectric elements, to thereby be output from the output terminal 118 as a waveform of the drive voltage.

As described above, according to the second embodiment of the present invention, the driving device 200 is configured to drive the plurality of piezoelectric elements of the liquid ejection head including the plurality of ejection orifices configured to eject liquid and the plurality of piezoelectric elements configured to generate energy for ejecting liquid from the ejection orifices. This driving device 200 includes the control circuit unit 102 and the drive circuit unit 103. The control circuit unit 102 includes the data tables 105, which are storage sections configured to store a plurality of pieces of drive voltage waveform data of different waveforms for controlling the ejection amount of liquid, and the selector 201, which is a transfer circuit configured to transfer the plurality of pieces of drive voltage waveform data stored in the data tables 105. The drive circuit unit 103 includes the plurality of individual drive circuit sections 21 arranged so as to correspond to the piezoelectric elements, respectively, and each configured to select one of the plurality of pieces of the drive voltage waveform data transferred by the selector 201 to drive a corresponding piezoelectric element with use of the selected piece of drive voltage waveform data. The control circuit unit 102 is an integrated circuit which is different from the drive circuit unit 103.

According to the driving device 200 described above, as in the first embodiment, the piezoelectric elements are driven with use of the drive voltage waveform data selected for each ejection orifice, thereby being capable of correcting the ejection amount for each ejection orifice. In the driving device 200, the control circuit unit 102 configured to store the drive voltage waveform data and the drive circuit units 103 configured to generate, from the drive voltage waveform data, the drive voltage to be applied to the piezoelectric elements are different integrated circuits. Thus, even when a high-voltage drive waveform is required, there is no need to manufacture the control circuit unit 102 through high-voltage processing, and only the drive circuit unit 103 needs to be manufactured through high-voltage processing. Therefore, as compared to the case where the control circuit unit 102 and the drive circuit unit 103 are mounted to the same integrated circuit and manufactured through the same processing, the circuit scale of the portion which needs to be manufactured through the high-voltage processing can be decreased, thereby being capable of suppressing an increase in cost.

The driving device 200 further includes the plurality of drive circuit units 103, and one control circuit unit 102 transfers the same drive voltage waveform data to each of the plurality of drive circuit units 103. With this configuration, even in a case where the number of the ejection orifices is increased, it is only necessary that the number of the drive circuit units 103 be increased depending on the number of ejection orifices, and there is no need to increase the number of the output terminals for the drive voltage waveform data. Thus, the increase in the circuit area can be suppressed, thereby suppressing the increase in the cost.

In the driving device 200, each individual drive circuit section 21 includes the latch circuit 204, the D/A conversion circuit 116, and the amplifier 117. The latch circuit 204 is a selection circuit configured to select one of the plurality of pieces of drive voltage waveform data transferred by the selector 201 which is a transfer circuit. The D/A conversion circuit 116 is a conversion circuit configured to convert the drive voltage waveform data selected by the latch circuit 204 into analog data. The amplifier 117 is an amplifier circuit configured to amplify a signal obtained by converting the drive voltage waveform data by the D/A conversion circuit 116 to drive the piezoelectric element.

The above-mentioned selector 201 is configured to sequentially select the drive voltage waveform data stored in the data table 105, and to output the data as parallel data in time division. With this, the drive voltage waveform data is output in the form of parallel data between the control circuit unit 102 and the drive circuit unit 103 from the data tables 105 to the latch circuit 204. With this configuration, there is no need to convert the data format of the drive voltage waveform data in the data tables 105 from parallel data into serial data. Thus, the circuit area is suppressed, thereby being capable of suppressing the increase in the cost.

The invention of the subject application is described above with reference to the embodiments, but the invention of the subject application is not limited to the above-mentioned embodiments. Various modifications understandable for a person skilled in the art may be made to the configurations and details of the invention of the subject application within the technical idea of the invention of the subject application.

For example, in the embodiments described above, the driving device for a liquid ejection apparatus for use in a printing apparatus configured to record an image is described. However, the present invention is not limited to the example. For example, the technology of the present invention is also applicable to a driving device for a liquid ejection apparatus for use in a printing apparatus configured to eject a conductive material to form a wiring pattern. Further, the printing apparatus may be a printing apparatus configured to form a three-dimensional object, in addition to a printing apparatus configured to record a two-dimensional image.

As described above, according to the present invention, even in a case where a high-voltage drive waveform is required for correction of the ejection amount for each ejection orifice, the circuit scale of the portion which needs to be manufactured through high-voltage processing can be decreased, thereby being capable of suppressing the increase in the manufacturing cost.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-208143, filed Oct. 22, 2015, which is hereby incorporated by reference herein in its entirety.

What is claimed is:

1. A driving device for a liquid ejection head, which is configured to drive a plurality of piezoelectric elements of the liquid ejection head, the liquid ejection head including a plurality of ejection orifices configured to eject liquid and the plurality of piezoelectric elements configured to generate energy for ejecting liquid from the plurality of ejection orifices, the driving device comprising:

a control circuit unit comprising:

storage sections configured to store a plurality of pieces of drive voltage waveform data of different waveforms for controlling an ejection amount of the liquid; and a transfer circuit configured to transfer the plurality of pieces of drive voltage waveform data stored in the storage sections; and a drive circuit unit comprising a plurality of individual drive circuit sections which are arranged so as to correspond to the plurality of piezoelectric elements, respectively, and each configured to select one of the plurality of pieces of drive voltage waveform data transferred by the transfer circuit to generate a drive voltage for driving a corresponding piezoelectric element with use of a selected piece of drive voltage waveform data, the control circuit unit comprising an integrated circuit which is different from the drive circuit unit.

2. The driving device according to claim 1, wherein the control circuit unit has a drive voltage lower than a drive voltage of the drive circuit unit.

3. The driving device according to claim 1, wherein the drive circuit unit comprises a plurality of drive circuit units, and wherein the control circuit unit is configured to transfer the same drive voltage waveform data to each of the plurality of drive circuit units.

4. The driving device according to claim 1, wherein each of the plurality of individual drive circuit sections comprises:

a selection circuit configured to select one of the plurality of pieces of drive voltage waveform data transferred by the transfer circuit;

a conversion circuit configured to convert the piece of drive voltage waveform data selected by the selection circuit into an analog signal; and an amplifier circuit configured to amplify the analog signal obtained by converting the piece of drive voltage waveform data by the conversion circuit to drive the corresponding piezoelectric element.

5. The driving device according to claim 1, wherein the transfer circuit is configured to convert the plurality of pieces of drive voltage waveform data stored in the storage sections into serial data, and to transfer the serial data.

6. The driving device according to claim 1, wherein the transfer circuit is configured to sequentially select the plurality of pieces of drive voltage waveform data stored in the storage sections, and to output the data as parallel data in time division.

* * * * *